US006326075B1

(12) United States Patent
Nagasaki et al.

(10) Patent No.: US 6,326,075 B1
(45) **Date of Patent: *Dec. 4, 2001**

(54) INK JET RECORDING MATERIAL

(75) Inventors: Shinichi Nagasaki, Kawasaki; Hideo Ikezawa, Tokyo; Hiromasa Kondo, Urawa, all of (JP)

(73) Assignee: Oji Paper Co., Ltd, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/184,042

(22) Filed: Nov. 2, 1998

(30) Foreign Application Priority Data

Nov. 5, 1997 (JP) ..... 9-302788

(51) Int. Cl.[7] ..... B65D 88/40
(52) U.S. Cl. ..... 428/195
(58) Field of Search ..... 428/195, 206, 428/211, 219

(56) References Cited

U.S. PATENT DOCUMENTS

| | | | | |
|---|---|---|---|---|
| 4,686,118 | | 8/1987 | Arai et al. . | |
| 5,180,624 | * | 1/1993 | Kojima et al. | 428/211 |
| 5,496,634 | * | 3/1996 | Ogawa et al. | 428/341 |
| 5,985,425 | * | 11/1999 | Tomizawa et al. | 428/212 |

FOREIGN PATENT DOCUMENTS

| | | |
|---|---|---|
| 0350257A1 | 1/1990 | (EP) . |
| 0545470A1 | 6/1993 | (EP) . |
| 0673779A1 | 9/1995 | (EP) . |
| 0 827 841 A1 | 3/1998 | (EP) . |
| 0827841A1 | 3/1998 | (EP) . |
| 52-53012 | 4/1977 | (JP) . |
| 53-49113 | 5/1978 | (JP) . |
| 55-51583 | 4/1980 | (JP) . |
| 55-150396 | 11/1980 | (JP) . |
| 56-84992 | 7/1981 | (JP) . |
| 56-148585 | 11/1981 | (JP) . |
| 58-110287 | 6/1983 | (JP) . |
| 59-185690 | 10/1984 | (JP) . |
| 60-161188 | 8/1985 | (JP) . |
| 61-141584 | 6/1986 | (JP) . |

OTHER PUBLICATIONS

Japanese Industrial Standard, "Testing Methods for Peel Strength of Adhesives," JIS K 6854, 1994.

* cited by examiner

*Primary Examiner*—Bruce H. Hess
*Assistant Examiner*—M. Grendzynski
(74) *Attorney, Agent, or Firm*—Arent Fox Kintner Plotkin & Kahn, PLLC

(57) ABSTRACT

An ink jet recording material having excellent ink jet recording performance and offset printing performance has an ink receiving layer formed on a support and containing a cationic resin, the ink receiving layer surface exhibiting a 180 degree peel strength from an adhesive tape adhered to the ink receiving layer surface of 0.15 kN/m or more, determined in accordance with JIS k 6854, and an extract of the ink jet recording material with water at 20° C. at a recording material/water weight ratio of 1:50, has a total solid weight of 1,000 mg or less per $m^2$ of the ink receiving layer surface area.

5 Claims, 1 Drawing Sheet

INK JET RECORDING MATERIAL

BACKGROUND OF THE INVENTION

1. Field of the Invention

The present invention relates to an ink jet recording material. More particularly, the present invention relates to an ink jet recording material having not only an excellent ink jet recording performance but also a superior offset printing adaptability.

2. Description of the Related Art

An ink jet recording system using an aqueous ink is advantageous in that printing noise is low, full colored images can be easily recorded, and the recording can be effected at a high speed, and the application of the ink jet recording system has progressed in many fields including, for example, terminal printers for computers, facsimile machines, plotters, and book and slip-printers.

Conventional woodfree paper sheets and coated paper sheets for usual printing are insufficient in ink absorption, and thus the ink images printed on the conventional paper sheet surface are kept in an undried condition for long time, the printer and printing paper sheets are stained by the undried ink images and the printed ink images are also soiled. Therefore, the conventional printing paper sheets are inadequate for ink jet recording in practice.

As a means for solving the above-mentioned problem, Japanese Unexamined Patent Publication No. 52-53,012 discloses a recording paper sheet, having a low sizing degree, usable as an ink jet recording sheet, and Japanese Unexamined Patent Publication No. 53-49,113 discloses an ink jet recording sheet prepared by impregnating a paper sheet containing a urea-formaldehyde resin, with a water soluble polymer. Also, for the purpose of enhancing colored ink image-forming properties and reproducibility of the colored ink images, various recording sheets having a recording surface layer formed by coating various porous inorganic pigments, for example, amorphous silica pigments are disclosed in Japanese Unexamined Patent Publication No. 55-51,583 and No. 56-148,585.

For the purpose of forming colored ink images having a high accuracy by preventing spreading of the ink, Japanese Unexamined Patent Publication No. 58-110,287, No. 59-185,690 and No. 61-141,584 disclose various porous pigments, having improved specific physical properties, usable for the ink jet recording sheets.

Further, Japanese Unexamined Patent Publication No. 55-150,396 discloses a method of imparting a cationic polymer and a water-soluble metal salt capable of reacting with a dye contained in an ink to form a water-insoluble metal lake, to recorded ink images on an ink jet recording material, to prevent blotting of the ink when the recording material is wetted with water. For the same purpose as mentioned above, Japanese Unexamined Patent Publication No. 56-84,992 discloses an ink jet recording material in which a recording layer contains a polycationic polymeric electrolyte, and Japanese Unexamined Patent Publication No. 60-161,188 discloses an ink jet recording material of which a recording surface is coated with a resin type dye-fixing agent or the like.

Currently, due to a significant development of printing system, a new type of ink jet recording material having a high surface strength sufficient for high speed printing system, for example book and slip-printing system, and an excellent water-resistance is required. The images shown on the books and slips comprise fixed items, for example, background patterns, ruled lines, and addresses and variable items, for example, address and name, the number, and price of article. In a highly efficient practice, the fixed items are printed on the ink jet recording material by an offset printing system, and only variable items are printed by the ink jet recording system. Therefore, the ink jet recording material is required to have a satisfactory adaptability for offset printing.

To impart an excellent ink absorption to a recording surface of the ink jet recording material, an ink receiving layer in which a porous pigment, for example, a xerogel pigment, is fixed with an amount as small as possible of a binder is preferably formed on a support surface. When, as an ink jet recording material, a woodfree paper type sheet on which a recording coat layer comprising, as a main component, a pigment, is coated in a small thickness is employed, an enhanced resistance to the feathering phenomenon and a high ink absorption can be imparted to the woodfree paper sheet by controlling the ash content, the sizing agent added to the paper-forming slurry and the size-press. However, when only the ink jet recording adaptability is seriously considered, and the amounts of the binder and the size-press agent are excessively reduced, or the content of ash is excessively increased, the resultant ink jet recording material exhibits an insufficient surface strength and, thus, in the offset printing procedure, various problems, for example, partial peeling and blanket-piling, easily occur.

Where the fixed items and variable items are printed on an ink jet recording sheet, the fixed items are printed by offset printing and then the variable items are printed by an ink jet recording. In the offset printing, a printing blanket is brought, in such a condition that an ink is present on an image portion and wetting water is present on a non-image portion of the blanket, into contact with the recording surface of the recording sheet. In the printing procedure, the recording sheet surface rapidly absorbs the wetting water supplied from the blanket to the sheet surface in a first colored image printing step, and then is brought into contact with a blanket for a second colored image printing step. In this case, if the recording sheet surface has an insufficient surface strength, portions of the sheet surface are removed by the blanket. This phenomenon is referred to as a partial-peeling phenomenon. The removed portions of the paper sheet are successively accumulated on the blanket and, as a result, it becomes impossible to continue the printing. This phenomenon is referred to as a blanket piling phenomenon.

In the usual paper sheets for the offset printing, a sufficient surface strength for the offset printing can be easily imparted, and thus the above-mentioned phenomena substantially do not occur in practice. However, in the conventional ink jet recording paper sheet, the content of the binder contained in the ink receiving layer is kept at a low level to keep the ink-absorbing capacity of the ink receiving layer at a high level, and the adaptability of the resultant ink receiving layer to the offset printing has not been carefully considered. Therefore, when the conventional ink jet recording paper sheet is subjected to the offset printing, the problems of the partial-peeling phenomenon and the blanket-piling phenomenon occur.

Thus, the inventors of the present invention have noticed as follows.

In the conventional ink jet recording material, it has been difficult to attain both a satisfactory offset printing adaptability and an excellent water resistance of the ink jet images.

Also, as a binder for the ink receiving layer, a water-soluble binder is advantageously employed to enhance the ink absorption of the ink receiving layer. Further, with respect to the cationic polymer which is employed for the purpose of enhancing the water-resistance of the ink jet images, the water-resistance-enhancing effect of the cationic polymer increases with a decrease in molecular weight of the cationic polymer. The reason for this phenomenon has not yet been completely clarified. However, it is assumed that the solubility of the cationic polymer in the solvent medium of the ink increases with a decrease in the molecular weight of the cationic polymer, and thus the cationic polymer having a low molecular weight can be easily dissolved in the solvent medium of the ink and thus rapidly reacts with the dye in the ink.

Further, when the water-soluble resin for the binder of the ink receiving layer is employed in too large an amount, or when the cationic polymer used for the purpose of enhancing the water resistance of the colored images printed by the ink jet recording system has too low a molecular weight, the water-soluble resin and/or the cationic polymer is dissolved in the wetting water of the printing blanket, the dissolved binder and/or cationic polymer stains printing plate, blanket, and rolls of wetting water-supply device, and thus the recording sheet is also stained and the water-flow system is soiled. Thus, the printing per se is greatly affected.

SUMMARY OF THE INVENTION

An object of the present invention is to provide an ink jet recording material having an excellent ink jet printing performance and further a superior offset printing adaptability.

The above-mentioned object can be attained by the ink jet recording material of the present invention which comprises a support and an ink receiving layer, formed on the support and comprising a cationic resin, wherein, a peel strength of the ink receiving layer from an adhesive tape adhered thereto, at a peeling angle of 180 degrees is 0.15 kN/m or more, determined in accordance with Japanese Industrial Standard K 6854, and an extract extracted from the ink jet recording material with water at a temperature of 20° C. at a ratio in weight of the ink jet recording material to the extracting water of 1:50 has a total solid weight of 1,000 mg or less per $m^2$ of the surface area of the ink jet recording material.

In the ink jet recording material of the present invention, the ink receiving layer is preferably one formed by coating or impregnating the support with a coating liquid containing the cationic resin and a binder, and drying the resultant coating liquid layer.

Also, in the ink jet recording material of the present invention, when the extract of the ink jet recording material with water is subjected to a colloid titration with a titrant consisting of 1/400N aqueous potassium polyvinylsulfate solution, the amount of the added colloid titrant is 90 ml or less per $m^2$ of the surface area of the ink jet recording material.

In the ink jet recording material of the present invention, the cationic resin for the ink receiving layer preferably comprises at least one member selected from acrylamide-diallylamine salt of hydrochloric acid copolymers, dimethylamine-epichlorohydrin polycondensation products and diallyldimethyl ammonium chloride-acrylamide copolymers.

Also, in the ink jet recording material of the present invention, the binder for the ink receiving layer is preferably selected from water-soluble resins.

DESCRIPTION OF THE PREFERRED EMBODIMENTS

Figure 1:
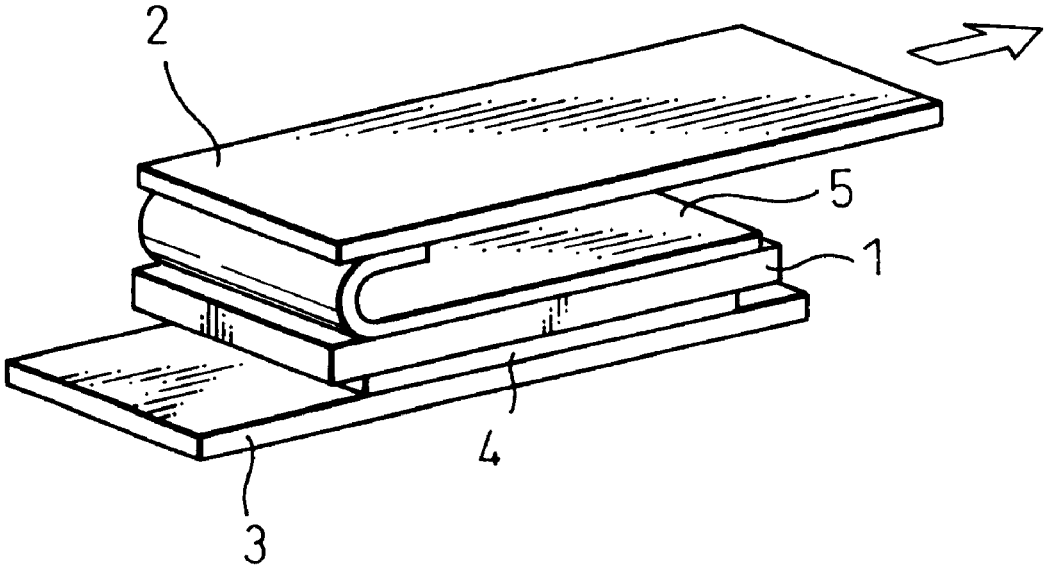
FIG. 1 shows a testing method of measuring a peel strength of an ink jet recording material of the present invention at a peeling angle of 180 degrees from an adhesive tape, in accordance with Japanese Industrial Standard K 6854-1994.

The inventors of the present invention have extensively researched the relationship between the excellent offset printing adaptability and the superior ink jet recording performance of the ink jet recording material, and as a result, found that when the ink receiving layer has a specific peel strength from an adhesive tape adhered thereto, and a extract of the ink jet recording material with water at specific conditions is a specific total solid weight, the resultant ink jet recording material has both the excellent ink jet recording performance and the superior offset printing adaptability, and the present invention is completed on the basis of the above-mentioned finding.

The support usable for the ink jet recording material of the present invention is not limited to a specific material. Usually, the support is formed from at least one member selected from paper sheets, nonwoven fabric and plastic polymer films or sheets. For the paper sheet usable for the support, the composition of the pulp component, ash content and the types and amounts of sizing agents for pulp slurry and size-press agents are adequately determined in consideration of the feathering property and ink absorption of the resultant paper sheet. Generally speaking, in the composition of the pulp component, the higher the content of a hardwood pulp and the higher the ash content, the higher the resistance of the resultant paper sheet to the feathering. The ash content is preferably controlled to about 1 to 15% by weight. A thick paper sheet for the support can be produced by optionally adding a paper-forming pulp slurry with a filler, for example, kaolin, calcined kaolin and/or calcium carbonate, and paper-forming the pulp slurry by a conventional acid or neutral paper-forming method. There is no limitation to the nonwoven fabric for the support and conventional nonwoven fabrics can be used for support of the present invention. For example, the nonwoven fabrics usable for the support can be produced by forming a web from at least one member selected from natural fibers, for example, pulp, and cotton fibers, rayon fibers, and synthetic fibers, for example, polyester, polyolefin and polyamide fibers which are used alone or in combination of two or more thereof, by a conventional wet web-forming method, carding method, or air-lay method; and subjected the web to a procedure for bonding or interlacing the fibers in the web to each other by a thermal bonding method, a resin-bonding method, a needle punching method or a spun-lacing method. Alternatively, the nonwoven fabric usable for the support can be produced from a thermoplastic resin, for example, a polyolefin, polyester or polyamide resin by a spun-bond method, a melt-blow method or a flush spinning method.

The support may be formed from the above-mentioned nonwoven fabrics alone or in a laminate of two or more thereof. For example, at least one of the above-mentioned nonwoven fabrics may be laminated with at least one thermoplastic resin film, for example, polyolefin films, polypropylene films and polyester films.

The films or sheets usable for the support may be selected from thermoplastic polymer films or sheets, for example, olefin homopolymer and copolymer films and sheets (for example, polyethylene, polypropylene, ethylene-propylene copolymer and ethylene-vinyl acetate copolymer films and sheets), which can be used alone or in a laminate of two or more thereof. The olefin homopolymers and copolymers are optionally mixed with other thermoplastic polymers, for example, polystyrene resins and acrylate ester homopolymer or copolymer resins. The thermoplastic resin film or sheets optionally contains fine inorganic particles. When an undrawn thermoplastic film or sheet containing fine inorganic particles is monoaxially or biaxially drawn, the resultant monoaxially or biaxially oriented film or sheet has paper-like appearance and touch and is usable as a synthetic paper sheet.

In the ink jet recording material of the present invention, a coating liquid for forming an ink receiving layer must contain a cationic resin for the purpose of enhancing the water-resistance of the ink receiving layer. The coating liquid optionally further comprises porous pigment particles for the purpose of imparting a high ink absorption to the ink receiving layer. Also, the coating liquid may further contain a binder or other additive for imparting other properties to the ink receiving layer.

In the ink jet recording material of the present invention, the porous pigments usable for the ink receiving layer preferably include inorganic porous pigments, for example, aluminum hydroxide, alumina, silica, magnesium oxide, colloidal silica, colloidal alumina, calcium carbonate, kaolin, talc, calcium sulfate, barium sulfate, titanium dioxide, zinc oxide, zinc carbonate, satin white, aluminum silicate, diatomaceus earth, calcium silicate, magnesium silicate and white carbon pigments, and organic pigments, for example, styrene resin, acrylic resin, urea-formaldehyde resin, melamine-formaldehyde resin, and benzoguanamine-formaldehyde resin pigments. The above-mentioned pigments are employed alone or in a mixture of two or more thereof.

Among the above-mentioned pigments, the silica pigments are advantageously utilized for the present invention, because the silica pigments have a relatively low index of refraction, the porous structure of the silica pigments can be easily controlled, and the silica pigment-containing ink receiving layer can have an excellent ink absorption and can record ink images having a high color density.

In an embodiment of the ink jet recording material of the present invention, the ink receiving layer preferably contains the porous pigment in an amount of 80% by weight or less, more preferably 70% by weight or less, still more preferably 50 to 70% by weight, based on the total weight of the ink receiving layer.

In the ink jet recording material of the present invention, the binder for the ink receiving layer includes conventional binders, for example, natural and semi-synthetic polymers, for example, starch and derivatives thereof such as cationic starch and oxidized starch, carboxy-methylcellulose, hydroxyethylcellulose, casein, gelatin and soybean protein; and aqueous solution and dispersion of synthetic polymers, for example, polyvinyl alcohols including non-modified polyvinyl alcohols and derivatives thereof such as silyl-modified polyvinyl alcohols and cation-modified polyvinyl alcohols, polyvinyl butyral resins, polyethyleneimine resins, polyvinyl pyrrolidone resins, poly(meth)acrylic acid resins, polyacrylate ester resins, polyamide resins, polyacrylamide resins, polyester resins, urea-formaldehyde resins, melamine-formaldehyde resins, styrene-butadiene copolymer resins, methyl methacrylate-butadiene copolymer resins and ethylene-vinyl acetate copolymer resins.

The above-mentioned polymers or copolymers may be modified by cationic or anionic groups, to provide cation or anion-modified polymers or copolymers. The polyvinyl alcohol is preferably selected from those having a high degree of polymerization of, for example, 800 or more, preferably 1,000 or more, and/or a high degree of saponification of, for example, 95% or more.

In the ink receiving layer of the present invention, the binder is preferably contained in a content of 10 to 70% by weight, more preferably 20 to 50% by weight, based on the total weight of the ink receiving layer.

The cationic resin contained in the ink receiving layer of the present invention for the purpose of enhancing the water resistance of the ink receiving layer, is preferably selected from polyethylene-imine resins, polyamine resins, polyamide resins, polyamide-epichlorohydrin resins, polyamine-epichlorohydrin resins, polyamidepolyamine-epichlorohydrin resins, polydiallylamine resins and dicyandiamide-polycondensation products for example, polyalkylenepolyamine-dicyandiamide copolymers. These cationic resins may be employed alone or in a mixture of two or more thereof. The cationic resins preferably have a molecular weight of 10,000 to 500,000, more preferably 10,000 to 200,000. There is no limitation to the content of the cationic resin in the ink receiving layer. Usually, the content of cationic resin is preferably 5 to 65% by weight, more preferably 10 to 50% by weight, based on the total weight of the ink receiving layer.

Optionally, the ink receiving layer of the present invention contains at least one additive selected from conventional additives, for example, pigment-dispersing agents, thickening agents, anti-foam agents, foam-restricting agents, foaming agent, releasing agents, penetrating agents, wetting agents, thermogelling agents, lubricants, etc.

In the ink jet recording material of the present invention, the means for forming the ink receiving layer on the support is adequately selected from conventional coating or impregnating means, for example, a size-press, gate roll, roll coater, bar coater, air knife coater, rod blade coater and blade coater.

There is no limitation to the coating amount of the ink receiving layer. Usually, when a woodfree paper sheet is used as a support and a coating liquid comprising, as principal components, a cationic resin and a binder is coated on or impregnated in the support, the amount of the resultant ink receiving layer is preferably 0.5 to 7 $g/m^2$ after drying. When the ink receiving layer comprising a porous pigment, a cationic resin, and a binder is formed on a support by a coating method, the dry solid amount of the ink receiving layer is preferably 2 to 30 $g/m^2$. As mentioned above, the ink receiving layer is formed on the support by coating or impregnating a coating liquid containing a cationic resin and optionally a pigment on or in the support. When the resultant ink receiving layer is very thin or the content of the pigment in the ink receiving layer is low, it should be noted that in an electric microscopic observation, portions of the support surface may be observed through the thin ink receiving layer or the low pigment-content ink receiving layer.

In the present invention, the recording surface strength of the ink receiving layer of the ink jet recording material is represented by a peel strength between the ink receiving layer and an adhesive tape adhered to the ink receiving layer at a peeling angle of 180 degrees, determined in accordance with the peel strength-testing method of Japanese Industrial Standard k 6854. In the ink jet recording material of the present invention, the peel strength between the ink receiving layer and an adhesive tape adhered thereto, at a peeling angle of 180 degrees is 0.15 kN/m or more, preferably 0.20 kN/m or more, more preferably 0.22 to 0.5 kN/m. When the peel strength is less than 0.15 kN/m, and the resultant ink receiving layer surface is subjected to offset printing, a partial-peeling phenomenon and a blanket-piling phenomenon easily occur during a long period of printing.

In a usual procedure for setting the above-mentioned 180 degree peel strength of a coated paper sheet-type ink jet recording material to a level of 0.15 kN/m or more, a water-soluble binder is preferably used in an amount of 20 parts by weight or more, more preferably 25 to 100 parts by weight, per 100 parts by weight of the pigment. When the ink jet recording material has a plain paper-like appearance due to a small amount of the ink receiving layer thereof, the peel strength of the ink jet recording material is enhanced by adding a paper strength-enhancing agent to the paper sheet, or by increasing the content of cationic starch in the paper sheet, or by decreasing the content of pigment in the paper-forming pulp slurry.

When extraction with water is applied to the ink jet recording material of the present invention at a temperature of 20° C. at a ratio in weight of the ink jet recording material to the extracting water of 1:50, the resultant extract has a total solid dry weight of 1,000 mg or less, preferably 800 mg or less, per $m^2$ of the surface area of the ink jet recording material. When the total solid weight of the extract is more than 1,000 $mg/m^2$, the resultant ink receiving layer causes background staining of the recording material, and contamination of the wetting water to occur, during the offset printing procedure. Particularly, the amount of the cationic resin extracted in the extract is too large, the background staining of the ink jet recording material increases. This trend increases with increase in the cation value of the cationic resin and with increase in the solubility in water of the cationic resin. Therefore, the type and content of the cationic resin contained in the ink receiving layer are selected and determined so that the extract of the resultant ink jet recording material with water under the above-mentioned conditions has a total solid weight of 1,000 $mg/m^2$ or less.

The trend in background staining of the ink jet recording material can be grasped by measuring the content of the cations in the water extract by a colloid titration method. In a result of research by the inventors of the present invention, when a colloid titration with a titrant consisting of an aqueous 1/400N potassium polyvinyl-sulfate solution is applied to the water extract, the amount of the added titrant is preferably 90 ml or less, more preferably 70 ml or less, per $m^2$ of the surface area of the ink jet recording material.

To decrease the total amount of the binder and the cationic resin extracted with water, a latex-type binder may be employed for the ink receiving layer. However, when the latex-type binder is used in too large an amount, the water resistance of the ink receiving layer may be decreased. When polyvinyl alcohol is used as a water-soluble binder for the ink receiving layer, there is such a tendency that an increase in degree of polymerization and/or degree of saponification of the polyvinyl alcohol produces a decrease in an extraction amount of the polyvinyl alcohol in the extract.

EXAMPLES

The present invention will be further illustrated by the following examples which are merely representative and do not intend to limit the scope of the present invention in any way.

In the examples and comparative examples, the terms "part" and "%" are "part by weight" and "% by weight" unless specifically noticed otherwise.

The ink jet recording sheets produced in the examples and comparative examples were subjected to the following testings.

(1) 180 Degree Peel Strength

On a recording surface of an ink receiving layer of an ink jet recording sheet, an adhesive tape (trademark: SCOTCH CLEAR TAPE CH-24, made by SUMITOMO 3M CO., LTD.) was adhered, and a peel strength between the jet recording layer and the adhesive tape at a peeling angle of 180 degrees was measured in accordance with Japanese Industrial Standard (JIS) k 6854, in the manner as mentioned below.

The adhesive tape (trademark: SCOTCH CLEAR TAPE CH-24, made by SUMITOMO 3M CO., LTD.) had a peel strength of 850 g/25 m determined in accordance with Japanese Industrial Standard (JIS) Z 0237, 8.3.1 180 degree peeling method against a test plate. In this case, the adhesive tape was adhered to a SUS304 steel plate and peeled therefrom to determine the peel strength.

Referring to FIG. 1, a specimen 1 having a width of 25 mm and a length of 160 mm was fixed at a back surface thereof to an upper surface of a plastic plate 3 having a width of 25 mm and a length of 180 mm through a double adhesive-coated tape 4 having the same width as that of the specimen 1. This adhering operation was carefully carried out so that no air bubbles were formed in the adhering interfaces.

Then, an adhesive tape 5 (trademark: SCOTCH CLEAR TAPE CH-24, made by SUMITOMO 3M CO., LTD.) having a width of 24 mm was adhered to the ink receiving layer surface of the specimen 1. This adhesion was carried out by rolling a roller having a weight of 5 kg per 25 mm width of the specimen twice on the non-adhesive surface of the adhesive tape along the longitudinal axis of the specimen. This adhesion was carried out under a linear pressure of 2 kg/cm.

An end portion of the adhesive tape 5 extending to the outside of the specimen 1 was turned through an angle of 180 degrees and was adhered to a lower surface of a plastic plate 2.

The assembly, as shown in FIG. 1, was fixed to a constant speed tensile tester equipped with an automatic recorder (not shown), a crosshead (not shown) movable at a constant travelling speed and a fixed gripper (not shown), in such a manner that the plastic plate 3 extending over the specimen 1 is fixed to the fixed gripper and an end portion of the plastic plate 2 was fixed to the crosshead.

The plastic plate 2 was moved by the crosshead in parallel to the surface thereof, and the peel strength at 180 degrees between the ink receiving layer of the specimen 1 and the adhesive tape 5 was determined in accordance with JIS k 6854.

(2) Total Solid Amount of Water Extract

A weight of a specimen of an ink jet recording material (about 1 g) was accurately measured. The specimen was placed in distilled water in an amount of 50 g at a temperature of 20° C. and the extracting water was stirred by a magnetic stirrer at a rotation rate of 100 rpm for 15 seconds. The resultant water extract was filtered through a 5A filtering paper. A portion of the water extract in an amount of about 10 ml was sampled and accurately weighed. The specimen was dried at a temperature of 105° C. for 12 hours to obtain a dry solid. The weight of the dry solid was accurately measured. From the measured data, the total solid weight of the water extract per $m^2$ of the surface area of the specimen of the ink jet recording material was calculated.

(3) Colloid Titration of Water Extract

A specimen of an ink jet recording material (about 1 g) was accurately weighed, and placed in distilled water in an amount of 50 g at a temperature of 20° C. The extracting water was stirred by a magnetic stirrer at a rotation rate of 100 rpm for 15 seconds.

The resultant water extract was separated from the specimen by filtration with a 5A filter paper. A portion of the water extract was sampled in an amount of 5 ml. The sample of the water extract was subjected to colloid titration with a titrant consisting of a 1/400N potassium polyvinylsulfate (PVSK) solution, in the presence of an indicator consisting of Toluidine Blue. The result of the colloid titration was represented in an added amount of the titrant per $m^2$ of the surface area of the specimen of the ink jet recording material.

(4) Ink Jet Printing Performance of Ink Jet Recording Material

A specimen of an ink jet recording material was subjected to an ink jet printing test using an ink jet printer (model: MJ700V2C, made by SEIKO EPSON CO., LTD.) at a recording density of 720 dpi. The resultant colored images on the specimen was subjected to a color density measurement.

The color density of the colored images was evaluated in the following three classes.

| Class | Color density |
|---|---|
| A | Excellent |
| B | Satisfactory in practice |
| C | Low, practically useless |

To evaluate the water resistance of the printed colored images, 30 minutes after the printing, the printed specimen was immersed in distilled water at a temperature of 20° C. for 30 seconds. The water resistance of the colored images were evaluated in the following classes.

| Class | Water resistance |
|---|---|
| A | No ink is eluated into water |
| B | Ink is slightly eluated into water |
| C | Ink is certainly eluated into water |

(5) Adaptability to Offset Printing

A specimen of an ink jet recording material was subjected to an offset printing test under the following conditions:

Offset printing machine: MIYAKOSHI BUSINESS FORM PRINTER

Inks used:

First printing . . . T&K TOKA BEST CURE WRO INDIGO BLUE (CYAN)

Second printing . . . T&K TOKA BEST-CURE WRO MAGENTA

Wetting water: IF201 2% and IF202 1% (made by FUJI PHOTO FILM CO., LTD.)

After the specimen was printed in a length of 4,000 m by the offset printing procedure, the blanket piling, background stain of the printed sheet, soiling of the water-supply system and contamination of the wetting water were checked, and evaluated in the following three classes.

| Class | Offset printing adaptability |
|---|---|
| A | No blanket piling, no background stain of the printed sheet and no soiling of water-supply system occur |
| B | Slight blanket piling, slight background stain of printed sheet and/or slight soiling of water supply system in negligible extent occur |
| C | Not usable for practice due to significant blanket piling, background stain of printed sheet, soiling of water supply system |

Example 1

A coating liquid for an ink receiving layer was prepared in a total solid content of 18% by mixing 250 parts of a 10% aqueous solution of a silyl-modified polyvinyl alcohol having a degree of polymerization of 1,800 and a degree of saponification of 98% or more (trademark: KURARAY POVAL R-1130, made by KURARAY CO., LTD.) with 20 parts of an amorphous silica pigment (trademark: CARPLEX BS-304N, made by SHIONOGI SEIYAKU K.K.) and 80 parts of an amorphous silica pigment (trademark: FINESIL X-45, made by K.K. TOKUYAMA), while stirring the mixture to prepare a dispersion, and further mixing the dispersion with 10 parts of a cationic acrylamide-diallylamine salt of hydrochloric acid copolymer resin (trademark: SUMIRASE RESIN #1001, made by SUMITOMO CHEMICAL CO., LTD.).

Separately, a woodfree paper sheet having a basis weight of 70 g/$m^2$ and a Stöckigt sizing degree of 7 seconds and an ash content of 5% was produced from an aqueous slurry containing 100 parts of LBKP, 8 parts of precipitated calcium carbonate and 0.08 part of an alkenyl succinic anhydride by a paper-forming method.

The above-mentioned coating liquid was coated on a surface of the woodfree paper sheet by using a mayer bar and dried to form an ink receiving layer having a dry weight of 10 g/$m^2$. Then a calendering treatment was applied onto the ink receiving layer by using a super calender under a linear pressure of 50 kg/cm at a sheet-forwarding velocity of 5 m/min. An ink jet recording sheet was obtained.

Comparative Example 1

An ink jet recording sheet was produced by the same procedures as in Example 1, except that the cationic resin (trademark: SUMIRASE RESIN #1001) was replaced by 10 parts of a cationic dicyandiamide-diethylenetriamine polycondensation product resin (trademark: NEOFIX E-117, made by NIKKA CHEMICAL CO., LTD.).

Comparative Example 2

An ink jet recording sheet was produced by the same procedures as in Example 1, except that the silyl-modified polyvinyl alcohol was replaced by 100 parts of a partial saponified polyvinyl alcohol having a degree of polymerization of 500 and a degree of saponification of 81.5% (trademark: KURARAY POVAL 405, made by KURARAY CO., LTD.).

Example 2

A surface of a woodfree paper sheet produced from an aqueous pulp slurry containing 100 parts of LBKP, 8 parts of precipitated calcium carbonate and 0.06 part of alkenylsuccinic anhydride and having a basis weight of 70 g/m$^2$, a Stöckigt sizing degree of 4 seconds and an ash content of 5%, was coated with a coating liquid prepared by diluting a mixture of 50 parts of a cationic resin consisting of a dimethylamine-epichlorohydrin polycondensation product and having a molecular weight of 15,000 (trademark: HP-36K, made by SENKA K.K.) with 50 parts of oxidized starch (trademark: OJI ACE A, made by OJI CORNSTARCH CO., LTD.) with water, and having a solid content of 25%, by using a gate roll coater, and dried, to form an ink receiving layer having a dry weight of 1.0 g/m$^2$. An ink jet recording sheet was obtained.

Example 3

An ink jet recording sheet was produced by the same procedures as in Example 2, except that the cationic resin (trademark: HP-36K) was replaced by 50 parts of a cationic resin consisting of a dimethylamine-epichlorohydrin polycondensation product and having a molecular weight of 28,000 (trademark: HP-30K, made by SENKA K.K.).

Example 4

An ink jet recording sheet was produced by the same procedures as in Example 2, except that the cationic resin (trademark: HP-36K) was replaced by 50 parts of a cationic resin consisting of a dimethylamine-epichlorohydrin polycondensation product having a molecular weight of 30,000 (trademark: HP-31K, made by SENKA K.K.).

Comparative Example 3

An ink jet recording sheet was produced by the same procedures as in Example 2, except that 50 parts of the cationic resin (trademark: HP-36K) was replaced by 50 parts of a partial saponificated polyvinyl alcohol having a degree of polymerization of 500 and a degree of saponification of 81.5% (trademark: KURARAY POVAL 405, made by KURARAY CO., LTD.).

Example 5

An ink jet recording sheet was produced by the same procedures as in Example 2, except that the cationic resin (trademark: HP-36K) was replaced by 50 parts of a cationic resin consisting of a diallyldimethyl ammonium chloride-acrylamide copolymer and having a molecular weight of 200,000 (trademark: PAS-J-81, made by NITTO BOSEKI CO., LTD.).

Comparative Example 4

The same woodfree paper sheet as in Example 2, produced from the aqueous pulp slurry containing 100 parts of LBKP, 8 parts of precipitated calcium carbonate and 0.06 part of alkenylsuccinic anhydride, and having a basis weight of 70 g/m$^2$ and a Stöckigt sizing degree of 4 seconds was used as an ink jet recording sheet.

Each of the ink jet recording sheets of the examples and the comparative examples was subjected to the testings of (1) the 180 degree peel strength, (2) the total solid amount of water extract, (3) the colloid titration of water extract, (4) the ink jet printing performance of the ink jet recording sheet and (5) the adaptability to offset printing and evaluated. The test results are shown in Table 1.

TABLE 1

| | | Item | | | | | |
|---|---|---|---|---|---|---|---|
| | | 180° peel strength | Total solid amount of water extract | Titrant amount of colloid titration of water extract | Ink jet printing performance | | Adaptability to |
| No. | | (kN/m) | (mg/m$^2$) | (ml/m$^2$) | Color density | Water resistance | offset printing |
| Example | 1 | 0.23 | 250 | 50 | A | A | A |
| Comparative | 1 | 0.25 | 1315 | 100 | A | A | C(*)1 |
| Example | 2 | 0.12 | 1250 | 60 | A | A | C(*)2 |
| Example | 2 | 0.34 | 805 | 41 | B | A | A |
| | 3 | 0.35 | 650 | 30 | B | A | A |
| | 4 | 0.30 | 630 | 25 | B | A | A |
| Comparative Example | 3 | 0.40 | 1220 | 15 | B | C | C(*)3 |
| Example | 5 | 0.35 | 900 | 95 | B | A | B |
| Comparative Example | 4 | 0.45 | — | — | C | C | A |

Note:
(*)1. . . significant background stain of printed sheet
(*)2. . . significant blanket piling
(*)3. . . significant soiling of water supply system Table 1 clearly shows that the ink jet recording sheets of the examples exhibited excellent ink jet printing performance and superior adaptability to offset printing, in comparison with those of the comparative examples.

As illustrated above, the ink jet recording material of the present invention exhibits not only excellent ink jet printing performance but also superior adaptability to offset printing.

What we claim is:

1. An ink jet recording material comprising a support and an ink receiving layer formed on the support by coating or impregnating the support with a coating liquid containing a cationic resin having a molecular weight of 10,000 to 500,000, in an amount of 5 to 65% by dry solid weight based on the total dry solid content of the coating liquid, and a binder selected from water-soluble resins, and by drying the resultant coating liquid layer, the ink receiving layer being in a dry solid amount of 0.5 to 7 g/m$^2$, (1) the ink receiving layer having a peel strength, from an adhesive tape adhered thereto, at a peeling angle of 180 degrees of at least 0.15 kN/m, determined in accordance with Japanese Industrial Standard k 6854;

(2) an extract obtained from the ink jet recording material with water at a temperature of 20° C. at a ratio in weight of the ink jet recording material to the extracting water of 1:50 having a total solid weight of 1,000 mg or less per m$^2$ of the surface area of the ink jet recording material; and (3) when the extract of the ink jet recording material with water is subjected to a colloid titration with a titrant consisting of a 1/400N aqueous potassium polyvinylsulfate solution, the amount of the added titrant is 70 ml or less per m$^2$ of the surface area of the ink jet recording material;

so that the ink jet recording material is adaptable to offset printing.

2. The ink jet recording material as claimed in claim 1, wherein the cationic resin comprises at least one member selected from the group consisting of acrylamide-diallylamine salt copolymers, dimethylamine-epichlorohydrin polycondensation products and diallyldimethyl ammonium chloride-acrylamide copolymers.

3. The ink jet recording material as claimed in claim 1, wherein the coating liquid for the ink receiving layer further comprises porous pigment particles, in addition to the cationic resin and the binder, and coated in a dry solid amount of 2 to 30 g/m$^2$ on the support.

4. The ink jet recording material as claimed in claim 1, wherein the binder comprises at least one member selected from polyvinyl alcohols having a molecular weight of 800 or more.

5. The ink jet recording material as claimed in claim 1 or 4, wherein the binder comprises at least one member selected from polyvinyl alcohols having a degree of saponification of 95% or more.

* * * * *